US007178212B2

(12) United States Patent
Baiker

(10) Patent No.: US 7,178,212 B2
(45) Date of Patent: Feb. 20, 2007

(54) DEVICE AND METHOD FOR THE BLASTING TREATMENT OF CHANNEL INNER WALLS

(75) Inventor: Erwin Baiker, Jona (CH)

(73) Assignee: Baiker AG, Glattbrugg/Zuerich (CH)

( * ) Notice: Subject to any disclaimer, the term of this patent is extended or adjusted under 35 U.S.C. 154(b) by 322 days.

(21) Appl. No.: 10/656,831

(22) Filed: Sep. 5, 2003

(65) Prior Publication Data

US 2004/0111852 A1 Jun. 17, 2004

(30) Foreign Application Priority Data

Sep. 11, 2002 (EP) ..... 02020267

(51) Int. Cl.
*B21C 37/30* (2006.01)

(52) U.S. Cl. ..... 29/90.7; 72/53

(58) Field of Classification Search ..... 29/90.7; 72/53

See application file for complete search history.

(56) References Cited

U.S. PATENT DOCUMENTS 1,504,945 A * 8/1924 Dempsey et al. ..... 285/114
2,770,924 A * 11/1956 Mead et al. ..... 451/88
3,485,073 A * 12/1969 Burney ..... 72/53
3,624,967 A * 12/1971 Kamper et al. ..... 451/2
4,230,426 A * 10/1980 Avery et al. ..... 406/191
4,420,852 A * 12/1983 Bowlsby ..... 15/104.33
4,706,356 A 11/1987 Bianchi et al.
4,773,113 A * 9/1988 Russell ..... 15/4
5,933,903 A * 8/1999 Irwin ..... 15/104.33

FOREIGN PATENT DOCUMENTS

EP 0 882 923 12/1998

* cited by examiner

*Primary Examiner*—David P. Bryant
*Assistant Examiner*—Christopher M. Koehler
(74) *Attorney, Agent, or Firm*—Lipsitz & McAllister, LLC

(57) ABSTRACT

Device for carrying out a blasting treatment of the inner wall of a channel with a stream of balls which, for treating curved channels, has a tube for introducing the stream of balls into a channel, a stream deflection and outlet device at the end of the tube on the outlet side and a casing in the form of a helical spring on the outer side of the tube.

12 Claims, 1 Drawing Sheet

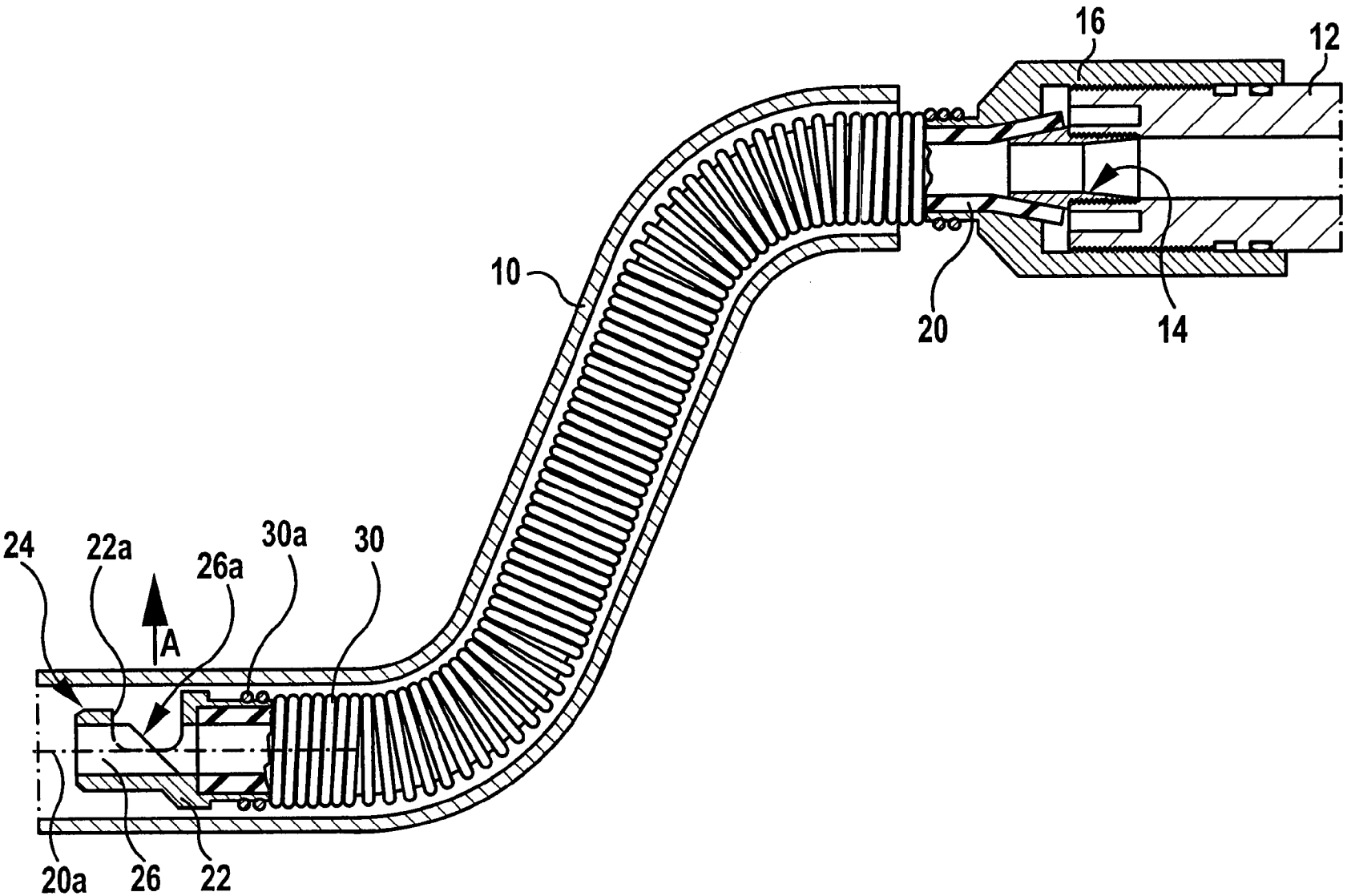
12
14
16
20
10
30
30a
26a
A
22a
24
22
26
20a

DEVICE AND METHOD FOR THE BLASTING TREATMENT OF CHANNEL INNER WALLS

The present disclosure relates to the subject matter disclosed in European application No. 02020267.7 of Sep. 11, 2002, which is incorporated herein by reference in its entirety and for all purposes.

BACKGROUND OF THE INVENTION

The invention relates to a device as well as a method for carrying out a blasting treatment of the inner wall of a channel with a stream of granular material, in particular, the inner wall of a metal pipe with a stream of metal balls (shot blasting).

The so-called ball or shot blasting is a known method for improving the strength of metallic surfaces; for example, during the maintenance of aircraft the front edges of the wings are acted upon with a stream of small metal balls. It is also already known to subject the walls of cavities in metallic objects to a blasting treatment, wherein the stream of balls is introduced into the cavity by means of a stiff lance having a longitudinal channel; if the wall of an elongated, straight cavity is intended to be treated with such a lance, a so-called interior blast nozzle is located at the forward end of the lance and the longitudinal channel of the lance opens into this nozzle which has a sloping surface which is inclined in relation to the axis of the lance and serves to deflect the stream of balls so that this exits from the blast nozzle transversely to the longitudinal axis of the lance.

This known device may be used for carrying out a blasting treatment of the inner wall of straight channels but not, however, when such a channel has one or more curvatures, as is the case for metal pipes which are used, for example, for stabilizers on motor vehicles as well as for the production of camshafts.

The object underlying the invention was therefore to provide a device of the type mentioned at the outset, with which the inner walls of channels which have one or more curvatures can be subjected to a blasting treatment, in particular, the inner walls of metal pipes having at least one curvature.

SUMMARY OF THE INVENTION

For this purpose, it is suggested in accordance with the invention that such a device be designed such that it has a flexible tube, in particular, a rubber or plastic tube for introducing the stream of particles into the channel, wherein a stream deflection and outlet device, with which the stream of particles can be directed against the channel wall, is attached to the end of the tube on the outlet side and that at least one projection reducing the friction between tube and channel wall or a casing of the tube reducing friction is provided at the outer side of the tube.

An inventive device could, for example, have a tube, during the production of which such a projection or several such projections is or are embedded into the tube wall, wherein the projection is of such a design and consists of such a material that the sliding friction between the channel wall and the projection is considerably less during relative movement between the tube and the channel wall than if the rubber or plastic tube were to abut a really on the channel wall. Flexible wires, which consist of a suitable metal or a suitable, low-friction plastic material, extend in a longitudinal direction of the tube and are arranged so as to be distributed uniformly over the circumference of the tube, could, for example, be embedded in the tube wall but likewise metal or plastic wire rings arranged at a distance from one another in a longitudinal direction of the tube or a metal or plastic wire coil which encompasses at least the largest part of the section of the tube to be introduced into the channel to be treated. In principle, it would, however, also be conceivable to provide the tube during its production with several burl-shaped elements which are embedded in the tube wall, form the projections in question and consist of a material reducing the sliding friction.

It is a matter of course that such a device may be used not only for ball blasting but rather for a blasting treatment with any granular material.

Those plastic materials which are adequately resistant in relation to the stream of particles directed through the tube but, on the other hand, are also sufficiently flexible are recommended as material for the tube and a particularly advantageous tube material is polyurethane.

In order to minimize the sliding friction, an elongated projection with a rounded head facing away from the wall of the tube (in cross section through the elongated projection) is recommended.

In order, where possible, to be able to use a tube which is commercially available, embodiments are recommended, with which the projection surrounds the tube in a spiral shape and is formed by a separate component, wherein the ends of the spiral are held in a longitudinal direction of the tube so as to be non-displaceable relative to the tube in order to avoid any displacement of the spiral on the tube when the tube is moved in the channel to be treated.

Embodiments are particularly preferred, with which the projection is formed by a metal or plastic helical spring enclosing the tube and pushed onto it.

If the projection (as in the case of a helical spring) is formed by a wire-like element, it is advantageous when its diameter is at the most equal to and preferably smaller than the thickness of the wall of the tube so that the flexibility of the tube is not impaired, at least not appreciably.

So that it can be ensured, even in the case of channels which are curved to a relatively great extent, that the tube does not come into contact with the channel wall, a particularly advantageous embodiment of the inventive device is characterized by the fact that the distance between sections of the helical spring adjacent to one another in a longitudinal direction of the tube is approximately the same as or smaller than the diameter of the spring wire when a tube extends in a straight line, and embodiments are particularly preferred, with which sections of the helical spring adjacent to one another in a longitudinal direction of the tube abut on one another in the case of a straight tube.

Furthermore, it is suggested in accordance with the invention, when carrying out a blasting treatment, that the inventive device be introduced into the channel to be treated and the tube, together with stream deflection and outlet device as well as the friction-reducing projection or the casing or helical spring, be turned about the tube axis and moved along the channel during the blasting treatment.

Additional features, advantages and details of the invention result from the attached, illustrative drawing as well as the following description of a particularly advantageous embodiment of the inventive device.

BRIEF DESCRIPTION OF THE DRAWING

The drawing shows a longitudinal section through the inventive device and through parts of a blasting treatment apparatus bordering on it as well as through a metal pipe to be treated, into which the inventive device has been introduced.

DETAILED DESCRIPTION OF THE INVENTION

A metal pipe 10 curved in an S shape is illustrated in the drawing, the inner wall surface of which is intended to be ball blasted in order to increase the durability of the pipe in relation to changes of load.

A stream of balls is introduced from a ball blasting apparatus, which is not illustrated, into a pipe 12 which is partially illustrated in the drawing and into which a support sleeve 14 is screwed. A clamping sleeve 16 may be screwed onto the end area of the pipe 12 shown in the drawing so that a tube 20 of the inventive device may be clamped between an inner cone of this clamping sleeve and an outer cone of the support sleeve 14, wherein the end of the tube is widened elastically by the support sleeve 14.

A nozzle member 22 of a blast nozzle 24 is secured to the other end of the tube 20, wherein the nozzle member engaging over the end of the tube can, for example, be adhered to the tube. A deflection member 26 is inserted into the sleeve-like nozzle member 22 and is, for example, secured by means of a suitable adhesive in the nozzle member; this deflection member has a deflecting surface 26*a* which is inclined in relation to the tube axis 20*a* through 45° and by means of which the balls of the stream of balls are deflected through 90° so that they leave the blast nozzle 24 through an exit opening 22*a* of the nozzle member 22 in the direction of the arrow A and impinge on the inner wall surface of the metal pipe to when the inventive device is inserted into the pipe 10. In order to prevent any jamming of the balls in the interior of the pipe, the external diameter of the nozzle member 22 in the area of its free end must, of course, be considerably smaller than the internal diameter of the metal pipe 10.

The tube 20 of the inventive device, which consists, in particular, of polyurethane, is surrounded by a metallic helical spring 30 which cannot move as a whole in relation to the tube 20 because, in accordance with the invention, the ends of the helical spring are secured relative to the tube 20: For this purpose, the two ends of the helical spring 30 are widened elastically, on the one hand, by the nozzle member 22 and, on the other hand, by the clamping sleeve 16; in addition, as is apparent in the drawing, the nozzle member 22 and the clamping sleeve 16 also form axial stops for the helical spring.

In accordance with the invention, the helical spring 30 which is commercially available is formed by a metal spring wire with a circular cross section, wherein the diameter of the spring wire is smaller than the thickness of the wall of the tube 20 and—when the tube 20 is, different to the illustration, stretched and has no curvatures—the sections of the helical spring adjacent to one another in a longitudinal direction of the tube abut, at least approximately, on one another. In this way, it is ensured that the helical spring 30 does not impair the flexibility of the tube 20, at least not appreciably, and, as is clearly apparent from the drawing, the outer wall surface of the tube 20 cannot come into contact with the inner wall surface of the workpiece, i.e., the pipe 10 even when the workpiece is curved to a relatively great extent.

During blasting of the interior of the pipe 10, the process is such that the tube 20 is inserted into the pipe 10 together with the helical spring 30 and the blast nozzle 24 and during the ball blasting the inventive device, i.e., all the parts illustrated in the drawing (apart from the pipe 10) are caused to rotate about the tube axis 20*a* and during the blasting process is or are drawn through the pipe 10 (in principle, it would, however, also be conceivable to insert the inventive device into the pipe 10 during the blasting process and move it forwards in it).

A suitable plastic wire could also replace the spring steel wire 30*a* forming the helical spring 30 when the plastic material selected for this purpose leads to the desired reduction in the sliding friction in relation to the workpiece to be treated.

In the preferred embodiment of the inventive device illustrated, the flexible tube is therefore encased with a helical spring which is wound relatively tightly and must, of course, have an adequate flexibility so that the inventive device may be pushed into the channels designated for a blasting treatment.

The invention claimed is:

1. A shot-peening apparatus for shot-peening, with a stream of shot-peening particles, an inner wall of a channel having at least one bend in a longitudinal direction thereof, said apparatus comprising:

a flexible plastic tube advanceable through the bent portion of the channel for introducing said stream of shot-peening particles into the bent portion of the channel, an outlet end on said tube, a particle deflection and outlet device attached to said outlet end for directing the shot-peening particles against the inner wall of said channel, and an elongated helically wound wire enclosing said tube for reducing friction between the tube and said inner wall when the tube is advanced through the channel.

2. The shot-peening apparatus of claim 1, wherein the tube is a polyurethane tube.

3. The shot-peening apparatus of claim 1, wherein the diameter of the wire is equal to the thickness of the wall of the tube.

4. The shot-peening apparatus of claim 1, wherein the diameter of the wire is smaller than the thickness of the wall of the tube.

5. The shot-peening apparatus of claim 1, wherein the distance between sections of the helically wound wire adjacent to one another in a longitudinal direction of the tube is approximately the same or smaller than the diameter of the wire when the tube extends in a straight line.

6. The shot-peening apparatus of claim 5, wherein sections of the helically wound wire adjacent to one another in a longitudinal direction of the tube abut on one another when the tube extends in a straight line.

7. The shot-peening apparatus of claim 1, wherein said wire is a spring wire.

8. The shot-peening apparatus of claim 1, wherein the helically wound wire has ends which are held at the tube to restrain displacement of the wire relative to the tube in a longitudinal direction of the tube.

9. The shot-peening apparatus of claim 1, wherein said channel is the inside of a bent pipe.

10. A method for shot-peening, with a stream of shot-peening particles, an inner wall of a channel having at least one bend in a longitudinal direction thereof, comprising:

advancing a flexible plastic tube enclosed in an elongated helically wound wire through the bent portion of the channel for introducing said stream of shot-peening particles into said bent portion, and directing the shot-peening particles against the inner wall of said channel via a particle deflection and outlet device attached to an outlet end of said tube, wherein friction between the tube and said inner wall is reduced by said wire when the tube is advanced through the channel.

11. The method of claim 10, wherein for shot-peening the inner wall of said channel, the tube is moved along the channel and turned about a tube axis of said tube.

12. The method of claim 10, wherein said channel is the inside of a bent pipe.

* * * * *